US009481079B2

(12) United States Patent
Taylor

(10) Patent No.: US 9,481,079 B2
(45) Date of Patent: Nov. 1, 2016

(54) GROUT REMOVAL TOOL

(76) Inventor: Michael Taylor, Santa Maria, CA (US)

( * ) Notice: Subject to any disclaimer, the term of this patent is extended or adjusted under 35 U.S.C. 154(b) by 1046 days.

(21) Appl. No.: 14/003,434

(22) PCT Filed: Apr. 20, 2011

(86) PCT No.: PCT/US2011/033279

§ 371 (c)(1),
(2), (4) Date: Sep. 5, 2013

(87) PCT Pub. No.: WO2011/133689

PCT Pub. Date: Oct. 27, 2011

(65) Prior Publication Data

US 2014/0014382 A1 Jan. 16, 2014

Related U.S. Application Data

(60) Provisional application No. 61/326,629, filed on Apr. 21, 2010.

(51) Int. Cl.

| | |
|---|---|
| ***B25F 5/00*** | (2006.01) |
| ***B25F 5/02*** | (2006.01) |
| ***E04F 21/00*** | (2006.01) |
| ***E04F 21/165*** | (2006.01) |

(52) U.S. Cl.

CPC ..... *B25F 5/00* (2013.01); *B25F 5/008* (2013.01); *B25F 5/02* (2013.01); *E04F 21/0084* (2013.01); *E04F 21/165* (2013.01)

(58) Field of Classification Search

CPC ..... B25F 5/00
USPC ..... 173/14, 46, 97, 214, 170, 104; 30/369; 279/143

See application file for complete search history.

(56) References Cited

U.S. PATENT DOCUMENTS

| | | | | |
|---|---|---|---|---|
| 2,385,439 | A * | 9/1945 | Gubbins | B25D 11/062 173/117 |
| 3,269,466 | A * | 8/1966 | Mitchell | B25D 11/005 173/103 |
| 3,476,438 | A * | 11/1969 | Bower, Jr. | E21C 35/18 175/377 |
| 3,587,754 | A * | 6/1971 | Laatsch | B21J 15/105 173/107 |
| 6,678,959 | B1 | 1/2004 | Phillip et al. | |
| 2005/0200087 | A1 * | 9/2005 | Vasudeva | B25F 3/00 279/143 |
| 2008/0314608 | A1 | 12/2008 | Berger et al. | |

* cited by examiner

*Primary Examiner* — Nathaniel Chukwurah
(74) *Attorney, Agent, or Firm* — Felix L. Fischer

(57) ABSTRACT

A grout removal tool incorporates a case (12) carrying a reciprocating motor (20) and having an external contoured finger grip (14). A drive shaft (28) extends from the motor to engage a chuck drive rod (30). A cooling piston (40) is concentrically carried by the drive shaft for reciprocating motion. A chuck (18) is attached to the chuck drive rod for removably constraining a carbide tipped bit (16).

8 Claims, 6 Drawing Sheets

GROUT REMOVAL TOOL

REFERENCE TO RELATED APPLICATIONS

This application claims priority of U.S. provisional application Ser. No. 61/326,629 filed on Apr. 21, 2010 by Michael Taylor entitled Grout Removal Tool the disclosure of which is incorporated herein by reference.

BACKGROUND INFORMATION

Field

Embodiments of the disclosure relate generally to the field of removal of grout between ceramic or other tile and more particularly to embodiments for a reciprocating tool for removal of grout with enhanced durability and ergonomic design.

BACKGROUND

The current art available for tile grout removal tools includes hand tools and electrically powered devices. Electrically powered devices include tools that work using a reciprocating motion or a rotary motion. Hand tools are very labor intensive and slow in removing tile grout. They are only practical for small areas of grout removal. Powered tools are typically limited to rotary and reciprocating saw tools.

Powered rotary tools use abrasive disks that rotate at a high RPM to remove grout. These tools create large amounts of dust and are difficult to control. During the grout removal process the abrasive disk can slip from the grout groove and damage the tile. Many tiles are set with small spaces between the tile. Tiles set with such small spacing between the tiles very often have misaligned grout lines. The rotary tools cannot be used to remove the grout in the areas where the two corners of the tiles meet without damaging the tile edges. Abrasive disks are typically ⅛" wide, so grout removal is limited to grout widths of more than ⅛'.

The available reciprocating tools use an existing reciprocating saw with a grout removal attachment. The attachment uses a metal grout removal blade with a row of teeth held parallel to the grout groove and removes the grout with a row of teeth held parallel to the grout groove and removes the grout with a sawing motion. Due to the heavy weight of the reciprocating saw the device is difficult to control which can cause the grout removal blade to slip from the grout groove and damage the tile surface. These devices have the same limitations as the rotary devices in that they cannot remove grout from narrow grout grooves at the corner intersections of slightly misaligned tiles. In addition, the wear on the grout removal blades is severe and requires frequent replacement. Replacement of the blades is time consuming, and costly. Because of the grinding motion of the grout removal blade much dust is created during the grout removal process. This device is generally limited to removing grout from grout lines that are ⅛" wide or greater.

The current grout removal tools, both reciprocating and rotary, require the use of a vacuum during use to manage the dust created. Use of the vacuum requires a second operator for the vacuum or the tool operator must manage both the vacuum and the grout removal tool which increases the difficulty of controlling the grout removal device and increases the possibility of tile damage.

It is therefore desirable to provide a powered grout removal tool which is durable, light weight and adapted for use with small or uneven grout lines.

SUMMARY

Embodiments described herein provide a grout removal tool that incorporates a case carrying a reciprocating motor and having an external contoured finger grip. A drive shaft extends from the motor to engage a chuck drive rod. A cooling piston is concentrically carried by the drive shaft for reciprocating motion. A chuck is attached to the chuck drive rod for removably constraining a carbide tipped bit.

The features, functions, and advantages that have been discussed can be achieved independently in various embodiments of the present invention or may be combined in yet other embodiments further details of which can be seen with reference to the following description and drawings.

DETAILED DESCRIPTION

Figure 1A:
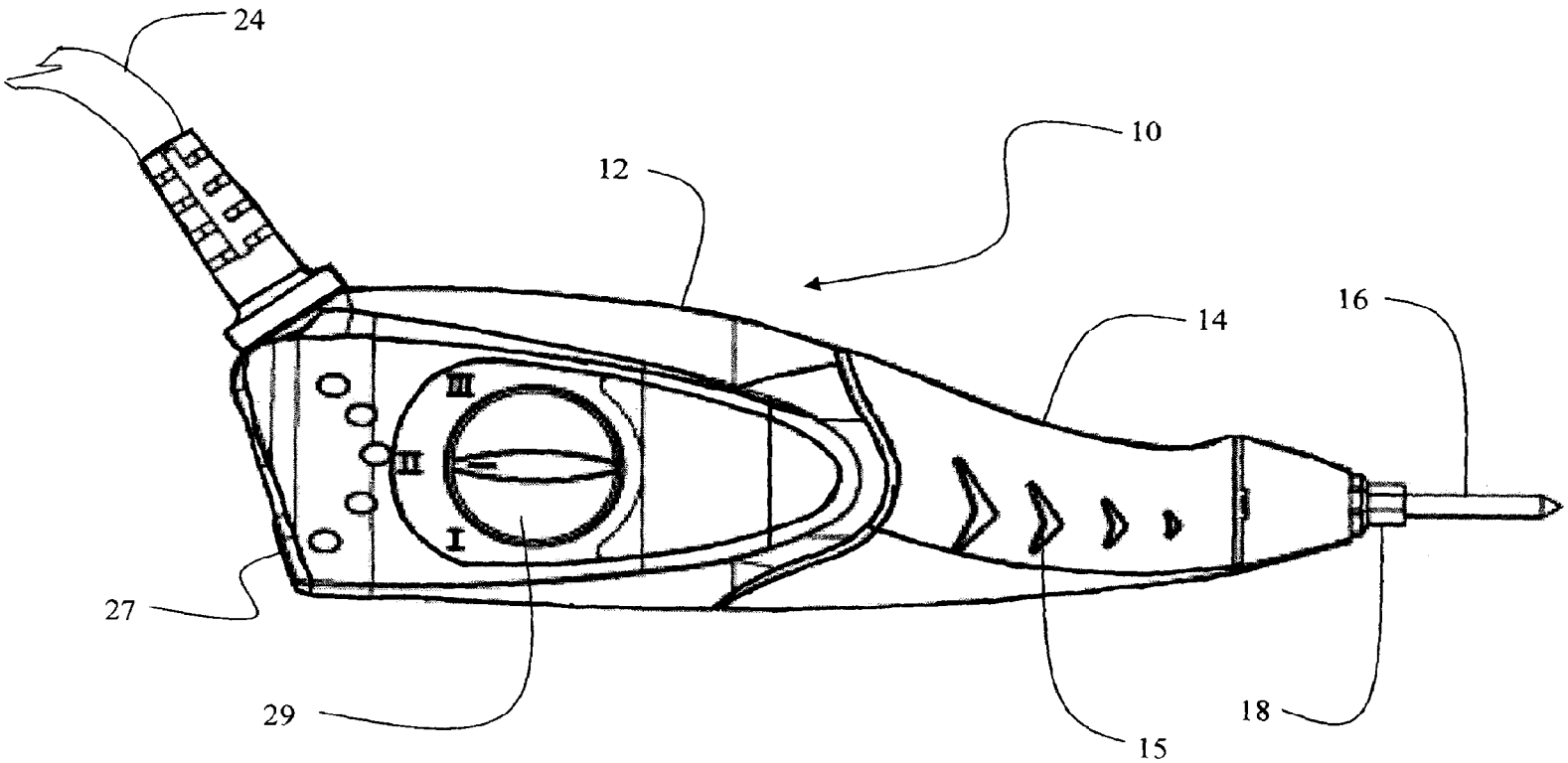
FIG. 1A is a right side view of an embodiment of the grout removal tool.
Figure 1B:
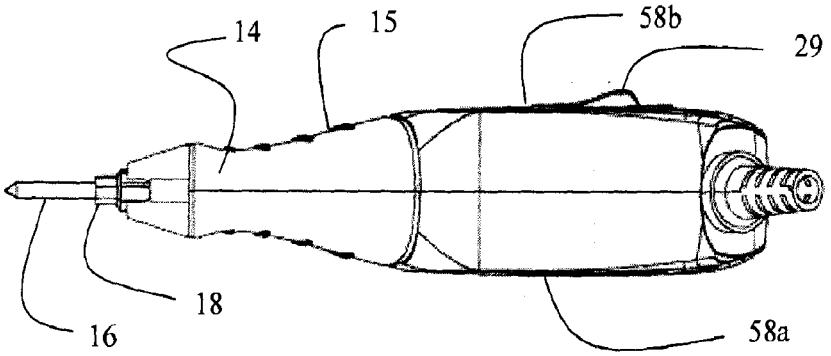
FIG. 1B is a top view of the embodiment of FIG. 1A.

The embodiment disclosed herein provides a smaller handheld, electrically powered reciprocating device with carbide tips secured to a chuck in the reciprocating device. As shown in FIGS. 1A-1E and 2, a grout removal tool 10 is provided with a contoured case 12 having a finger grip 14 to be held and manipulated by a user. The finger grip 14 is covered with a pliable material such as rubber or soft polyethylene to provide greater friction for gripping and to reduce imparted vibration to the fingers. Embossed chevrons 15 also enhance the surface of the grip. A removable carbide tip 16 is inserted in a chuck 18 in the grout removal tool 10, the operation of which will be described in greater detail subsequently.

The combination of the grout removal tool 10 and the carbide tip 16 allows tile grout to be chiseled loose rather than ground out as existing grout removal devices function. The carbide tip 16 is removable and various carbide tips can be configured to work with various sizes of grout widths and will effectively remove grout in areas where the grout lines are narrow and the tiles are misaligned. The shape of the carbide tip can be symmetrically pointed (as seen in FIGS. 1A-1E, 4 and 5) to precisely remove small amounts of grout or can be chisel shaped (as seen in FIGS. 2, 3, 6A and 6B) to remove larger amounts of grout.

Figure 1C:
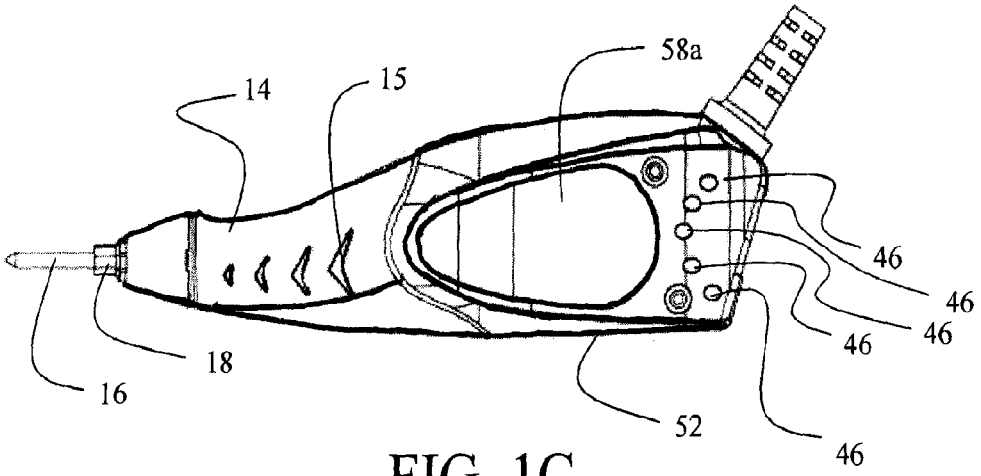
FIG. 1C is a left side view of the embodiment of FIG. 1A.
Figure 1D:
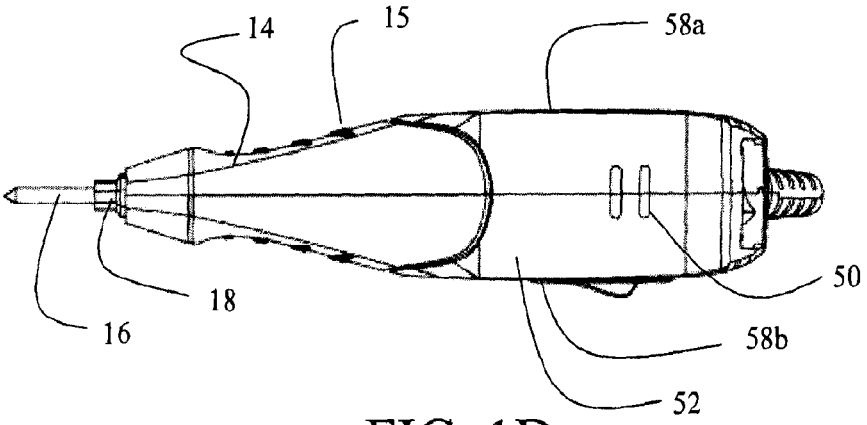
FIG. 1D is a bottom view of the embodiment of FIG. 1A.
Figure 1E:
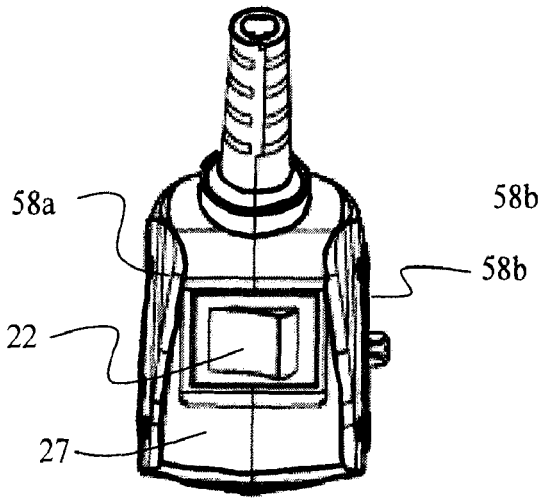
FIG. 1E is a rear view of the embodiment of FIG. 1A.
Figure 1F:
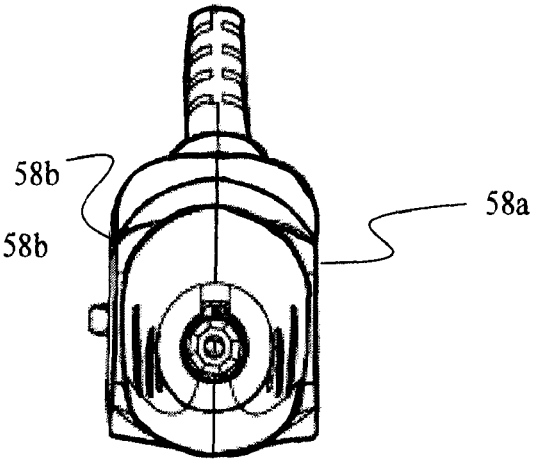
FIG. 1F is a front view of the embodiment of FIG. 1A
Figure 2:
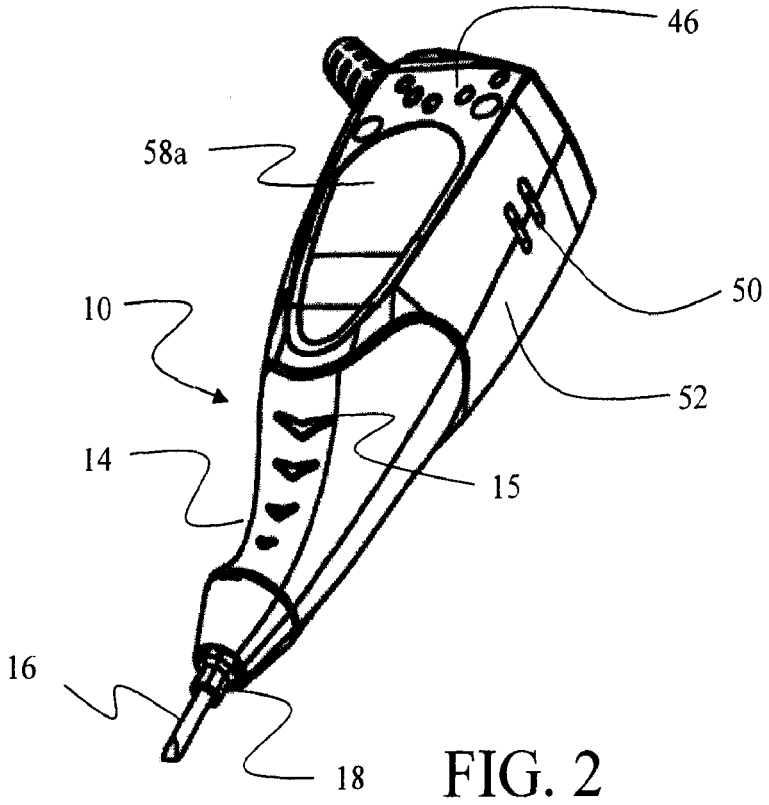
FIG. 2 is an isometric view of the embodiment shown in FIGS. 1A-1F with a chisel bit.
Figure 3:
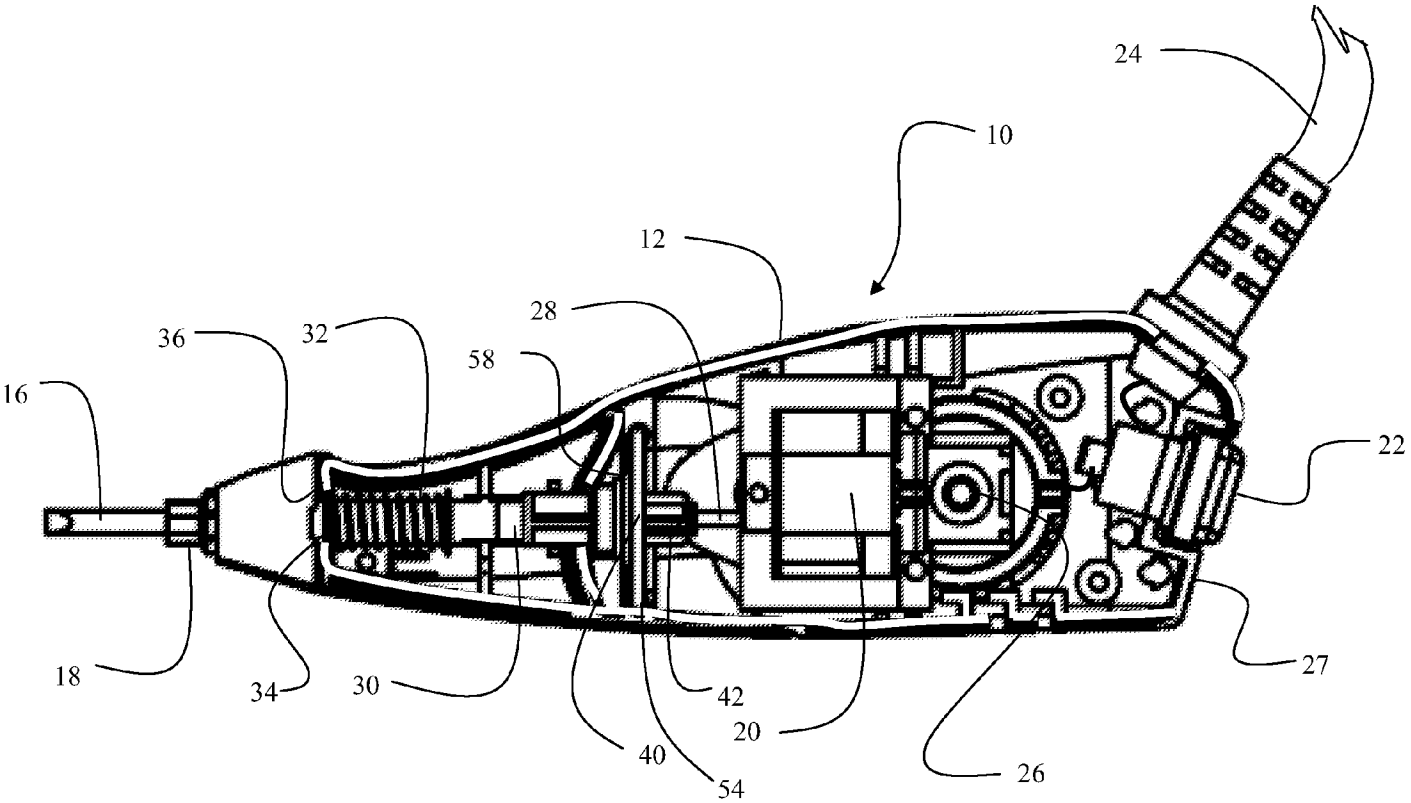
FIG. 3 is a side section view of the embodiment.
Figure 4:
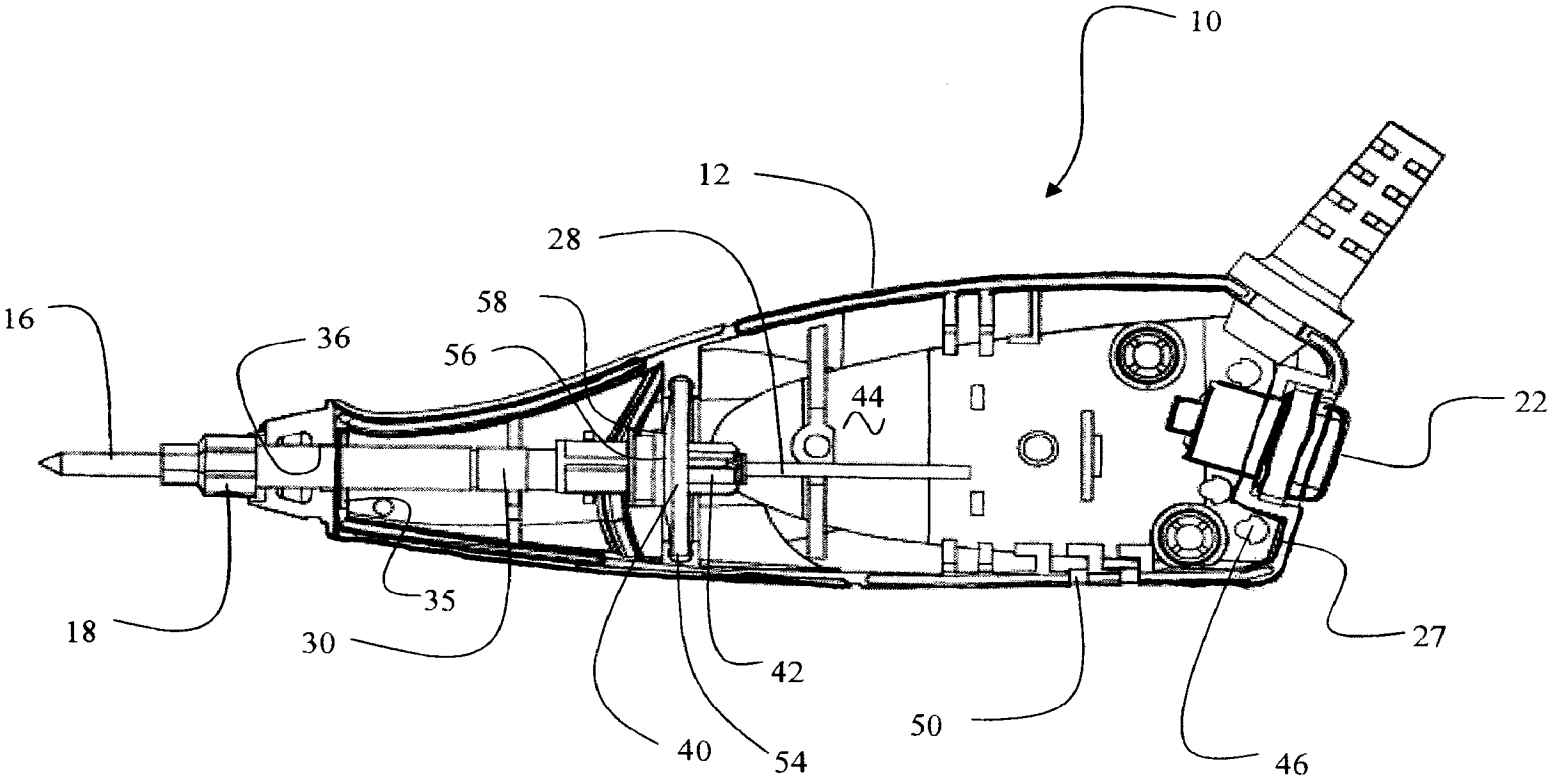
FIG. 4 is a side section view with the motor removed for clarity of other components.

FIGS. 3 and 4 show the internal components of the grout removal tool 10. A reciprocating motor 20 is carried in the case 12. A power switch 22 provides electrical power from a conventional 110 V power cord 24 to the motor through a control potentiometer 26. As seen in FIG. 1E, the switch is mounted on an external flat 27 on the rear of the case thereby avoiding unintentional operation of the switch when grasping the finger grip. Returning to FIG. 3, the travel of the reciprocating motor 20 is controllable by a dial 29 on the potentiometer 26 positionable at various settings as best seen in FIG. 1A (shown at intermediate setting II) which can be varied to increase or decrease the amount of grout being removed and change the precision of the tool. The power of the drive motor is increased over currently available similar devices to insure long motor life and adequate power to work more efficiently to remove large amounts of grout.

A drive shaft 28 extends from the motor for connection to a chuck drive rod 30 terminating in the chuck 18. As shown in FIG. 3 a spring 32 engages the drive rod for resilient reaction to the reciprocation of the motor enhancing the drive characteristics of the chuck and attached tip. Spring base 34 engages a shoulder 35 on the circumference of aperture 36 in case 12 through which drive rod 30 and chuck 18 protrude.

A cooling piston 40 is carried on the drive shaft 28 and/or chuck drive rod 30. For the embodiment shown, the center boss 42 of the piston provides the interengagement between the drive shaft and chuck drive rod. The cooling piston reciprocates with the drive shaft as driven by the reciprocating motor. Motion of the piston creates air flow within chamber 44 in the case 12 to provide cooling for the motor. Air flow is enhanced by apertures in the case including air vent holes 46 in sides 48*a* and 48*b* of the case (as best seen in FIGS. 1A and 1C as well as vent slots 50 in bottom 52 of the case (as best seen in FIG. 1D). In an original embodiment, the cooling piston 40 is a rigid plastic disc. For an exemplary embodiment shown, the cooling piston 40 is a flexible diaphragm having an outer ring 54 and an inner ring 56 joined by a reduced thickness membrane 58. In certain embodiments, the outer ring may be constrained in grooves in the inner wall of the case. In alternative embodiments, the outer ring is unconstrained and resonance between the outer ring and inner ring induced by the reciprocation of the drive shaft may enhance the motion of the membrane. Cooling of the motor with the cooling piston significantly enhances the durability and life of the motor. The simplified form of the piston avoids costly fabrication and operation of alternative cooling devices such as a fan.

Figure 5:
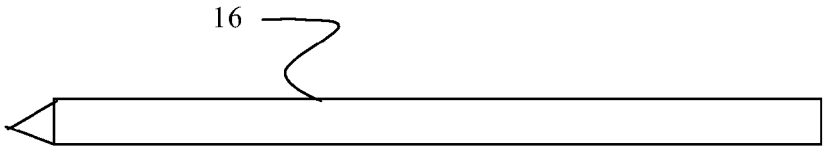
FIG. 5 is a side view of a pointed tip carbide bit for use with the grout removal tool.
Figure 6A:
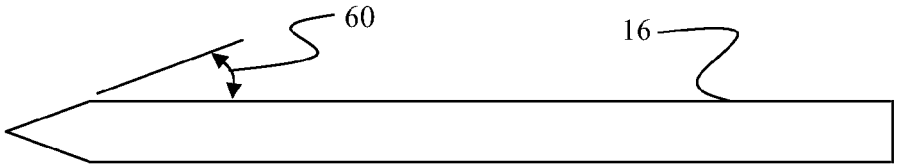
FIG. 6A is a side view of a chisel tip carbide bit.
Figure 6B:
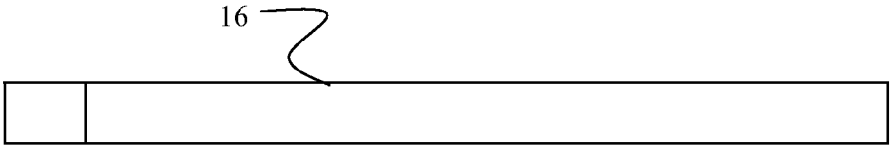
FIG. 6B is a bottom view of the chisel tip carbide bit of FIG. 6A.

The carbide tips 16 shown in FIGS. 5, 6A and 6B have virtually no wear during the life of the tips and thereby reduce the time to replace tips and replacement tip costs. The angle 60 of the chisel tips for the grout removal tool is optimized to provide the desired precision and grout removal speed.

Being of a smaller size than similar reciprocating devices used for grout removal makes the tool easy to control and reduces significantly the possibility of damage to the tile. The combination of size, cooling and efficient carbide tips with a motor size enlarged for heavy duty use allows the motor and grout removal tool to be operated continuously as opposed to prior art devices which required repeated shut down for cooling purposes. The chiseling motion for grout removal also increases the operation control over the tool which also reduces significantly any tile damage. The features of this new grout removal tool allow large areas of grout to be removed with reduced labor and tile damage.

The grout removal tool can be used to remove all sizes of grout from between tiles and allow the old grout to be replaced extending the life of the tile. The grout removal tool can be used to remove grout for tile floors, counter tops, shower and tub enclosures, and any other application using grouted tiles. Due to the ease of use and control the grout removal tool can be used to remove grout from large areas such as complete counter tops and shower and tub enclosures.

The grout removal tool can be used with narrow grout lines and in situations where the tiles are misaligned without damaging the tile surface. Removing grout on misaligned, narrow grout lines cannot be accomplished effectively with existing tools.

Various size and configurations of tips can be used depending on the precision necessary for different grout removal applications. Pointed tips can be used when precision is required or chisel shaped tips can be used when large amounts of grout need to be removed more rapidly.

Grout removal is accomplished by selecting the correct tip for the grout removal application. A pointed tip is selected where precision is required, or the grout line is narrow. A wider chisel tip is used when the grout line is wide and it is appropriate to remove large amounts of grout at a time. The pointed tip can also be used effectively when removing grout at corners where tiles are perpendicular to each other.

The grout removal tip is mounted into the chuck affixed to the front of the grout removal tool. The tip is held in the chuck by a set screw or frictionally engaged by segregated collate lips with a threaded cap which holds the tip in place during operation.

The proper tip travel is selected with the rotary dial of the adjustment potentiometer on the side of the tool. Shorter travels are selected for situations requiring precise control of the tip and longer travels are selected for situations where large amounts of grout are to be removed. The power switch is activated and the tip is held at an angle to the grout. The angle is determined by the amount of grout being removed, and the style of tip being used. The tool is moved forward along the grout line removing grout from the grout line.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A grout removal tool comprises:

a case carrying a reciprocating motor and having an external contoured finger grip;

a drive shaft extending from the motor to engage a chuck drive rod, a cooling piston concentrically carried by the drive shaft for reciprocating motion; and, a chuck attached to the chuck drive rod for removably constraining a carbide tipped bit.

2. The grout removal tool as defined in claim 1 further comprising a power switch mounted in the case and interconnected between a power cord and the motor for controlling electrical power to the motor.

3. The grout removal tool as defined in claim 2 further comprising a potentiometer connected between the power switch and motor for varying travel of the reciprocating motor.

4. The grout removal tool as defined in claim 3 wherein the switch is mounted on a rear flat on the case and the potentiometer has an adjustment dial mounted on a side of the case.

5. The grout removal tool as defined in claim 1 wherein the case incorporates a plurality of apertures for airflow.

6. The grout removal tool as defined in claim 5 wherein the plurality of apertures include a series of vent holes on each side of the case and multiple vent slots on a bottom of the case.

7. The grout removal tool as defined in claim 1 wherein the cooling piston incorporates a center boss the drive shaft and chuck drive rod for interconnection.

8. The grout removal tool as defined in claim 1 where further comprising a spring concentrically received on and engaging the chuck drive rod at a first end and a shoulder on a circumference of an aperture in the case through which the chuck protrudes for resilient resistance to the reciprocating motion of the motor.

* * * * *